US006058733A

United States Patent [19]

Morgan

[11] Patent Number: 6,058,733

[45] Date of Patent: May 9, 2000

[54] WATER COOLER WITH COMPARTMENTALIZED STORAGE AREA

[76] Inventor: Andy D. Morgan, Rte. 1 Box 107-B, Charleston, Miss. 38921

[21] Appl. No.: 09/061,216

[22] Filed: Apr. 16, 1998

[51] Int. Cl.[7] ..... B67D 5/62

[52] U.S. Cl. ..... 62/389; 62/457.4; 62/457.5; 62/339

[58] Field of Search ..... 62/457.4, 457.5, 62/389, 339

[56] References Cited

U.S. PATENT DOCUMENTS

| | | | |
|---|---|---|---|
| 3,605,435 | 9/1971 | Taylor | 62/457 |
| 4,491,520 | 1/1985 | Jaye | 210/232 |
| 5,269,156 | 12/1993 | Van De Velde et al. | 62/457.4 |
| 5,295,369 | 3/1994 | Garcia | 62/389 |
| 5,755,057 | 5/1998 | Dancer | 43/54.1 |

*Primary Examiner*—Henry Bennett
*Assistant Examiner*—Mark Shulman

[57] ABSTRACT

A new water cooler with compartmentalized storage area for transporting large quantities of water and individual canned beverages. The inventive device includes an insulated cooler having a generally cylindrical configuration. The cooler has an opening through an upper end thereof into a hollow interior. The hollow interior receives a water container therein. The water container has a plurality of radially spaced recesses each extending a length of the container. The insulated cooler has a plurality of elongated openings in a side thereof corresponding with the radially spaced recesses of the water container. A plurality of insulated sleeves are hingedly coupled with the four elongated openings of the insulated cooler. Each of the sleeves have a recessed interior for receiving beverage cans therein whereby when the sleeves are closed within the insulated cooler, the beverage cans rest between the recessed interior and the recess of the water container.

5 Claims, 3 Drawing Sheets

WATER COOLER WITH COMPARTMENTALIZED STORAGE AREA

BACKGROUND OF THE INVENTION

1. Field of the Invention

The present invention relates to beverage dispensers and more particularly pertains to a new water cooler with compartmentalized storage area for transporting large quantities of water and individual canned beverages.

2. Description of the Prior Art

The use of beverage dispensers is known in the prior art. More specifically, beverage dispensers heretofore devised and utilized are known to consist basically of familiar, expected and obvious structural configurations, notwithstanding the myriad of designs encompassed by the crowded prior art which have been developed for the fulfillment of countless objectives and requirements.

Known prior art beverage dispensers include U.S. Pat. No. 4,516,409 to Hobbs, Jr. et al.; U.S. Pat. No. 5,385,275 to Billet; U.S. Pat. No. 4,924,682 to Penner; U.S. Pat. No. 4,910,977 to Hilton; U.S. Pat. No. 2,730,151 to Smith; and U.S. Pat. No. 3,161,031 to Flannery.

While these devices fulfill their respective, particular objectives and requirements, the aforementioned patents do not disclose a new water cooler with compartmentalized storage area. The inventive device includes an insulated cooler having a generally cylindrical configuration. The cooler has an opening through an upper end thereof into a hollow interior. The hollow interior receives a water container therein. The water container has a plurality of radially spaced recesses each extending a length of the container. The insulated cooler has a plurality of elongated openings in a side thereof corresponding with the radially spaced recesses of the water container. A plurality of insulated sleeves are hingedly coupled with the four elongated openings of the insulated cooler. Each of the sleeves have a recessed interior for receiving beverage cans therein whereby when the sleeves are closed within the insulated cooler, the beverage cans rest between the recessed interior and the recess of the water container.

In these respects, the water cooler with compartmentalized storage area according to the present invention substantially departs from the conventional concepts and designs of the prior art, and in so doing provides an apparatus primarily developed for the purpose of transporting large quantities of water and individual canned beverages.

SUMMARY OF THE INVENTION

In view of the foregoing disadvantages inherent in the known types of beverage dispensers now present in the prior art, the present invention provides a new water cooler with compartmentalized storage area construction wherein the same can be utilized for transporting large quantities of water and individual canned beverages.

The general purpose of the present invention, which will be described subsequently in greater detail, is to provide a new water cooler with compartmentalized storage area apparatus and method which has many of the advantages of the beverage dispensers mentioned heretofore and many novel features that result in a new water cooler with compartmentalized storage area which is not anticipated, rendered obvious, suggested, or even implied by any of the prior art beverage dispensers, either alone or in any combination thereof.

To attain this, the present invention generally comprises an insulated cooler having a generally cylindrical configuration. The cooler has an opening through an upper end thereof into a hollow interior. The upper end has an annular recess disposed around the opening thereof. The cooler has a handle pivotally coupled with the upper end disposed within the annular recess. The hollow interior receives a water container therein. The water container has a cap removably coupled with an upper end thereof. The water container has a spigot extending outwardly therefrom and extending outwardly of the insulated cooler. The water container has four radially spaced recesses each extending a length of the container. The insulated cooler has four elongated openings in a side thereof corresponding with the four radially spaced recesses of the water container. Four insulated sleeves are hingedly coupled with the four elongated openings of the insulated cooler. Each of the sleeves have a recessed interior for receiving beverage cans therein whereby when the sleeves are closed within the insulated cooler, the beverage cans rest between the recessed interior and the recess of the water container. An upper end of the sleeves each have a lock disposed thereon for engaging an upper end of the elongated opening of the insulated cooler.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new water cooler with compartmentalized storage area apparatus and method which has many of the advantages of the beverage dispensers mentioned heretofore and many novel features that result in a new water cooler with compartmentalized storage area which is not anticipated, rendered obvious, suggested, or even implied by any of the prior art beverage dispensers, either alone or in any combination thereof.

It is another object of the present invention to provide a new water cooler with compartmentalized storage area which may be easily and efficiently manufactured and marketed.

It is a further object of the present invention to provide a new water cooler with compartmentalized storage area which is of a durable and reliable construction.

An even further object of the present invention is to provide a new water cooler with compartmentalized storage area which is susceptible of a low cost of manufacture with regard to both materials and labor, and which accordingly is then susceptible of low prices of sale to the consuming public, thereby making such water cooler with compartmentalized storage area economically available to the buying public.

Still yet another object of the present invention is to provide a new water cooler with compartmentalized storage area which provides in the apparatuses and methods of the prior art some of the advantages thereof, while simultaneously overcoming some of the disadvantages normally associated therewith.

Still another object of the present invention is to provide a new water cooler with compartmentalized storage area for transporting large quantities of water and individual canned beverages.

Yet another object of the present invention is to provide a new water cooler with compartmentalized storage area which includes an insulated cooler having a generally cylindrical configuration. The cooler has an opening through an upper end thereof into a hollow interior. The hollow interior receives a water container therein. The water container has a plurality of radially spaced recesses each extending a length of the container. The insulated cooler has a plurality of elongated openings in a side thereof corresponding with the radially spaced recesses of the water container. A plurality of insulated sleeves are hingedly coupled with the four elongated openings of the insulated cooler. Each of the sleeves have a recessed interior for receiving beverage cans therein whereby when the sleeves are closed within the insulated cooler, the beverage cans rest between the recessed interior and the recess of the water container.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
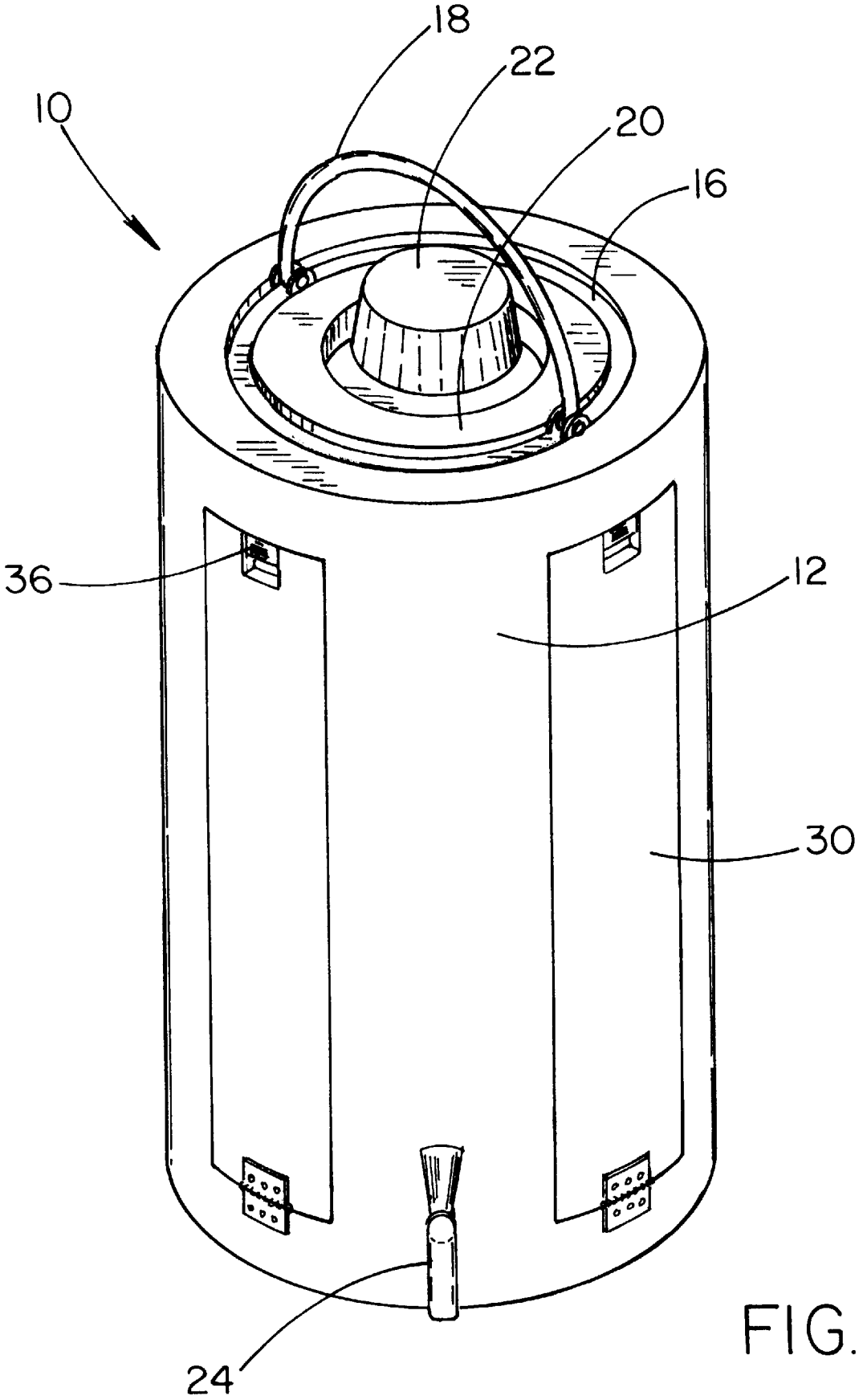
FIG. 1 is a perspective view of a new water cooler with compartmentalized storage area according to the present invention.
Figure 2:
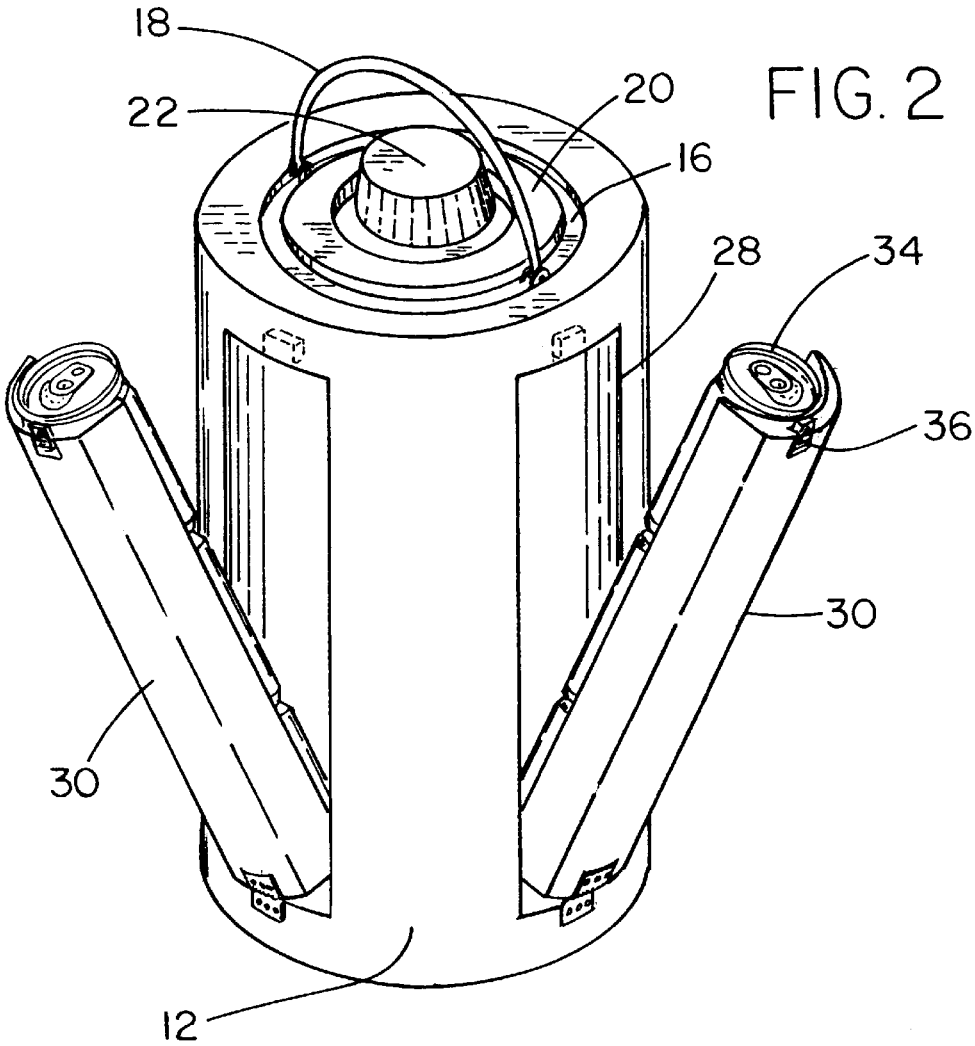
FIG. 2 is a perspective view of the present invention illustrated in an open orientation.
Figure 3:
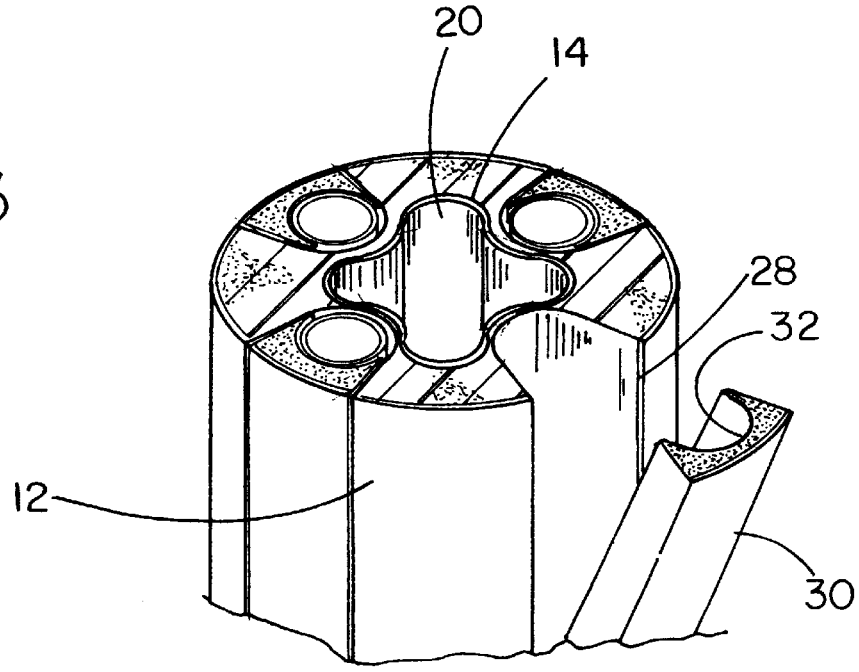
FIG. 3 is a perspective sectional view of the present invention.
Figure 4:
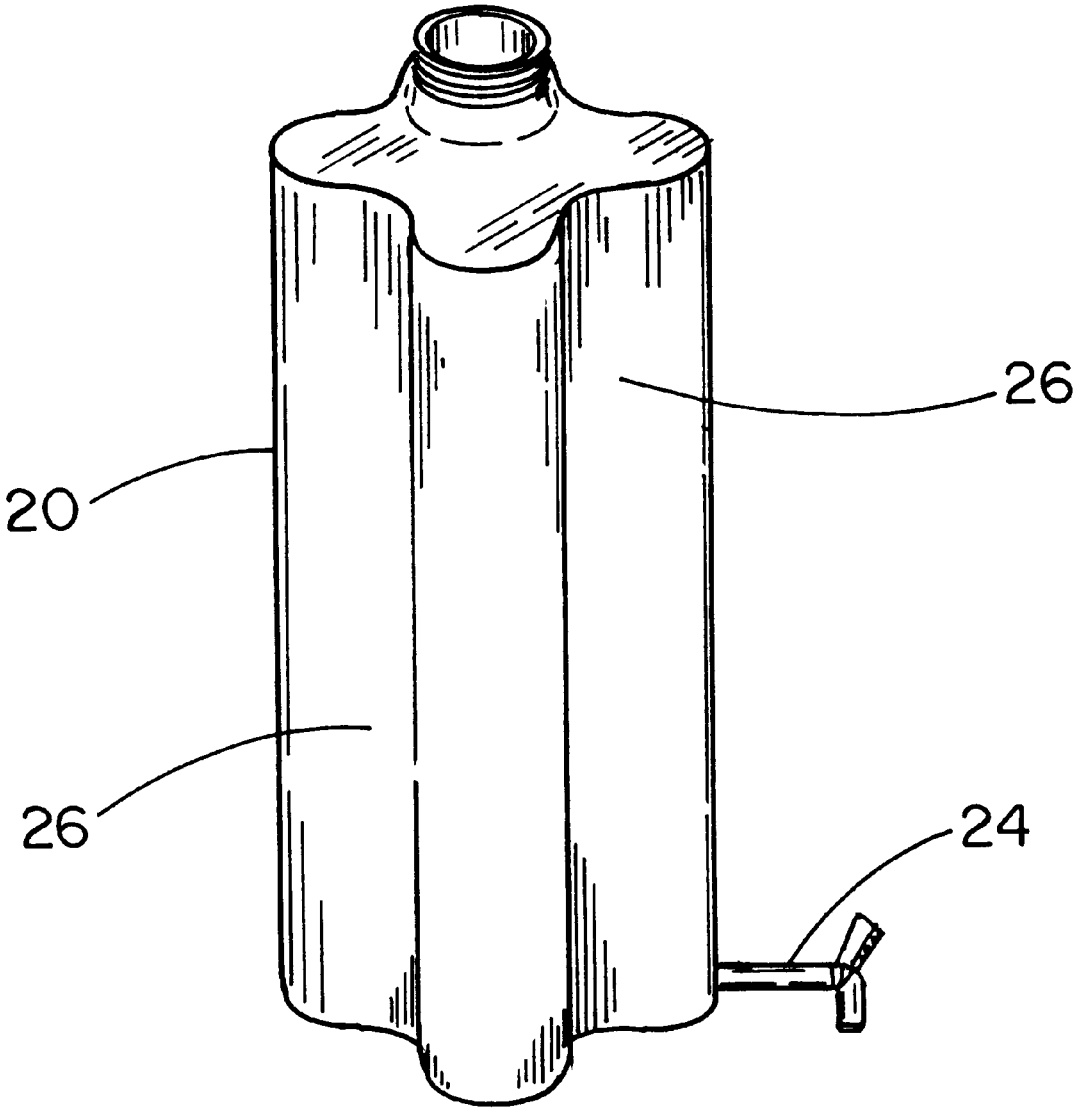
FIG. 4 is a perspective view of the interior water container of the present invention.

With reference now to the drawings, and in particular to FIGS. 1 through 4 thereof, a new water cooler with compartmentalized storage area embodying the principles and concepts of the present invention and generally designated by the reference numeral 10 will be described.

As best illustrated in FIGS. 1 through 4, the water cooler with compartmentalized storage area 10 comprises an insulated cooler 12 having a generally cylindrical configuration. The cooler 12 has an opening through an upper end thereof into a hollow interior 14. The upper end has an annular recess 16 disposed around the opening thereof. The cooler 12 has a handle 18 pivotally coupled with the upper end disposed within the annular recess 16. The hollow interior 14 receives a water container 20 therein. The water container 20 has a cap 22 removably coupled with an upper end thereof. The water container 20 has a spigot 24 extending outwardly therefrom and extending outwardly of the insulated cooler 12. The water container 20 has four radially spaced recesses 26 each extending a length of the container 20. The insulated cooler 12 has four elongated openings 28 in a side thereof corresponding with the four radially spaced recesses 26 of the water container 12. The water container would be filled with ice water.

Four insulated sleeves 30 are hingedly coupled with the four elongated openings 28 of the insulated cooler 12. Each of the sleeves 30 have a recessed interior 32 for receiving beverage cans 34 therein whereby when the sleeves 30 are closed within the insulated cooler 12, the beverage cans 34 rest between the recessed interior 32 and the recess 26 of the water container 20. An upper end of the sleeves 30 each have a lock 36 disposed thereon for engaging an upper end of the elongated opening 28 of the insulated cooler 12.

In use, the insulated sleeves 30 would hold a total of twelve 12-ounce beverage cans. The sleeves 30 are hingedly secured to the bottom of the elongated openings 28 thereby allowing an individual to pull open the sleeves 30, drop in an assortment of canned beverages, and then lock the sleeves 30 to the insulated sleeves 12. The cans 34 would then be kept cool by being stored against the water container 20.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A water cooler system with compartmentalized storage area for transporting large quantities of water and individual canned beverages comprising, in combination:

an insulated cooler having a generally cylindrical configuration with a lower end for resting on a surface, the cooler having an opening through an upper end thereof into a hollow interior, the cooler having a handle pivotally coupled to the upper end thereof, the hollow interior receiving a water container therein such that a longitudinal axis of the water container is coaxial with a longitudinal axis of the cooler whereby a center of gravity of an amount of fluid held in said water container is substantially longitudinally aligned with a center of gravity of the cooler for facilitating a centralized distribution of weight in the cooler during use, the water container having a cap removably threadedly coupled with an upper end thereof, the water container having a spigot extending outwardly therefrom and extending outwardly of the insulated cooler, the water container having four radially spaced recesses each extending a length of the water container, the insulated cooler having four elongated openings in a side thereof corresponding with the four radially spaced recesses of the water container, wherein insulation is positioned between an outer wall of the insulated cooler and the water container, the insulation having gaps therein corresponding to each of the four elongated openings;

four insulated sleeves hingedly coupled with the four elongated openings of the insulated cooler, each of the sleeves having a recessed interior surface for receiving beverage cans therein whereby when the sleeves are closed within the insulated cooler, the beverage cans rest between the recessed interior surface and against the recess of the water container for permitting thermal transfer between the cans and the water container, an upper end of the sleeves each having a lock disposed thereon for engaging an upper end of the elongated opening of the insulated cooler.

2. The water cooler system as set forth in claim 1 wherein the upper end of the cooler has an annular recess disposed around the opening thereof, the cooler further having a handle pivotally coupled with the upper end and adapted to be removably disposed within the annular recess.

3. The water cooler system as set forth in claim 1 wherein the hollow interior and the water container each has a horizontal cross-section section with a cloverleaf-shaped configuration along a height thereof such that the sleeves abut recesses of the hollow interior when in the closed orientation, wherein the insulation is positioned between protrusions of the hollow interior and the outer wall of the cooler.

4. The water cooler system as set forth in claim 1 wherein the sleeves are each hingably attached via hinges coupled between an outer surface of the sleeve and an outer surface of the outer wall of the cooler.

5. A water cooler system with compartmentalized storage area for transporting large quantities of water and individual canned beverages comprising, in combination:

an insulated cooler having a generally cylindrical configuration, the cooler having an opening through an upper end thereof into a hollow interior, the cooler having a handle pivotally coupled to the upper end thereof, the hollow interior receiving a water container therein such that a longitudinal axis of the water container is coaxial with a longitudinal axis of the cooler whereby a center of gravity of an amount of fluid held in said water container is substantially aligned with a center of gravity of the cooler for facilitating even distribution of weight around the cooler during use, the water container having a cap removably threadedly coupled with an upper end thereof, the water container having a spigot extending outwardly therefrom and extending outwardly of the insulated cooler, the water container having four radially spaced recesses each extending a length of the water container, the insulated cooler having four elongated openings in a side thereof corresponding with the four radially spaced recesses of the water container, wherein insulation is positioned between an outer wall of the insulated cooler and the hollow interior;

four insulated sleeves hingedly coupled with the four elongated openings of the insulated cooler, each of the sleeves having a recessed interior for receiving beverage cans therein whereby when the sleeves are closed within the insulated cooler, the beverage cans rest between the recessed interior and the recess of the water container, an upper end of the sleeves each having a lock disposed thereon for engaging an upper end of the elongated opening of the insulated cooler;

wherein the upper end of the cooler has an annular recess disposed around the opening thereof, the cooler further having a handle pivotally coupled with the upper end and adapted to be removably disposed within the annular recess;

wherein the hollow interior and the water container each has a horizontal cross-section with a cloverleaf-shaped configuration along a height thereof such that the sleeves abut recesses of the hollow interior when in the closed orientation, wherein the insulation is positioned between protrusions of the hollow interior and the outer wall of the cooler; and wherein the sleeves are each hingably attached via hinges coupled between an outer surface of the sleeve and an outer surface of the outer wall of the cooler.

* * * * *